US011779934B2

(12) United States Patent
Rizzo

(10) Patent No.: US 11,779,934 B2
(45) Date of Patent: Oct. 10, 2023

(54) AGGREGATE PRODUCTION SYSTEM AND METHOD

(71) Applicant: Recycled Granite Corporation, St. John, IN (US)

(72) Inventor: Julie Rizzo, Crete, IL (US)

(73) Assignee: Recycled Granite Corporation, St. John, IN (US)

( * ) Notice: Subject to any disclaimer, the term of this patent is extended or adjusted under 35 U.S.C. 154(b) by 237 days.

(21) Appl. No.: 17/467,875

(22) Filed: Sep. 7, 2021

(65) Prior Publication Data

US 2022/0072559 A1 Mar. 10, 2022

Related U.S. Application Data

(60) Provisional application No. 63/075,474, filed on Sep. 8, 2020.

(51) Int. Cl.

| | |
|---|---|
| ***B02C 23/08*** | (2006.01) |
| ***B07C 5/342*** | (2006.01) |
| ***B07C 5/06*** | (2006.01) |
| ***B07B 13/07*** | (2006.01) |

(52) U.S. Cl.

CPC ..... *B02C 23/08* (2013.01); *B07B 13/07* (2013.01); *B07C 5/06* (2013.01); *B07C 5/3425* (2013.01); *B02C 2201/06* (2013.01); *B07C 2501/0054* (2013.01)

(58) Field of Classification Search

CPC ..... B02C 23/08; B02C 23/14; B02C 2201/06; B07B 13/07; B07B 13/072; B07C 5/10; B07C 5/342; B09B 3/35

See application file for complete search history.

(56) References Cited

FOREIGN PATENT DOCUMENTS

| | | | | | |
|---|---|---|---|---|---|
| CN | 107262387 | A | * | 10/2017 | ..... B07C 5/3416 |
| CN | 110523505 | A | * | 12/2019 | ..... B02C 21/00 |
| JP | 2014226576 | A | * | 12/2014 | ..... B09B 5/00 |
| KR | 100441286 | B1 | * | 7/2004 | ..... B09B 3/00 |
| KR | 20190104658 | A | * | 3/2018 | ..... B02C 23/08 |

OTHER PUBLICATIONS

Translation of CN-110523505 (Year: 2019).*
Translation of KR-20190104658 (Year: 2018).*
Translation of CN-107262387 (Year: 2017).*
Translation of JP-2014226576 (Year: 2014).*
Translation of KR-100441286 (Year: 2004).*

* cited by examiner

*Primary Examiner* — Bobby Yeonjin Kim
(74) *Attorney, Agent, or Firm* — Iandiorio Teska & Coleman, LLP

(57) ABSTRACT

An aggregate production method includes procuring stone waste by-products, sorting the stone waste by-products by type and color, and subjecting the sorted stone waste by-products to a two-stage crushing process to produce aggregate. The aggregate is screened into different sizes and placed according to size into a bag or container.

26 Claims, 7 Drawing Sheets

AGGREGATE PRODUCTION SYSTEM AND METHOD

RELATED APPLICATIONS

This application claims benefit of and priority to U.S. Provisional Application Ser. No. 63/075,474 filed Sep. 8, 2020, under 35 U.S.C. §§ 119, 120, 363, 365, and 37 C.F.R. § 1.55 and § 1.78, which is incorporated herein by this reference.

FIELD OF THE INVENTION

This subject invention relates to stone aggregate products useful in a variety of applications.

BACKGROUND OF THE INVENTION

Stone aggregate is used as soil mineralizer, in chip seal and eco-glitter products, in coatings, in polysand products, in tiles, countertops, and the like.

SUMMARY OF THE INVENTION

By using stone waste by-products as the source of stone aggregate, the numerous positive effects of recycling are realized including reducing waste usually sent to landfills.

Featured is an aggregate production method comprising procuring stone waste by-products, sorting the stone waste by-products by type and color, and subjecting the sorted stone waste by-products to a one and/or two-stage crushing process to produce aggregate. The aggregate is screened into different sizes placed according to size into a bag or container.

The method may further include extracting product less than a predetermined size before washing and drying. In one example, the waste by-products include stone remnants and/or construction debris. Sorting may include sorting various granites and quartz into different bins.

One preferred method further includes drying the different size aggregate after washing the aggregate. Drying may include placing the aggregate into heated aluminum trays.

The fines may be extracted during crushing and mineralizer and/or rock dust can be extracted after screening.

Also featured is an aggregate production method comprising sorting stone waste by-products by type and color, subjecting the sorted stone waste by-products to a crushing process to produce aggregate, screening the aggregate into different sizes, washing the aggregate, drying the aggregate, and placing the aggregate according to size into a bag or container.

Also featured is an aggregate production method comprising procuring stone waste by-products, sorting the stone waste by-products by type and color, subjecting the sorted stone waste by-products to a crushing process to produce aggregate and fines, extracting the fines, screening the aggregate into different sizes, extracting mineralizer and/or rock dust, and placing the aggregate according to size into a bag or container.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
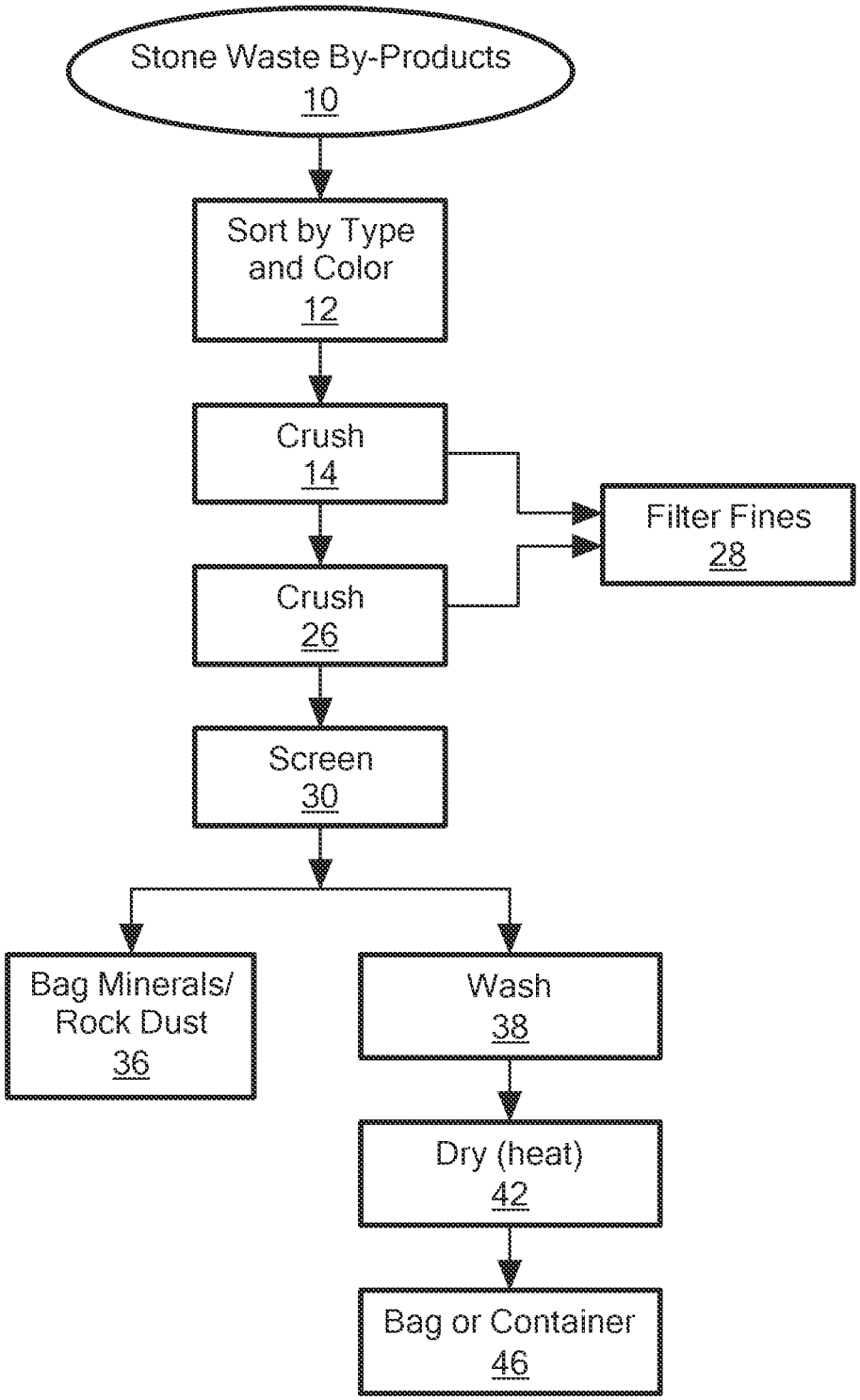
FIG. 1 is flow chart depicting the primary steps associated with one preferred aggregate production method.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Stone waste products including, for example, granite from countertop cut-offs and other product remnants are used as a source material for the preferred aggregate production method, as shown at 10, FIG. 1. Other source materials used includes cemetery headstones and construction debris such as when bathrooms and kitchens are remodeled.

In step 12, the waste by-products are sorting by type and color, usually manually. Granite, for example, may be sorted by its different colors, e.g. white, black, and brown. In some cases, different waste products types and colors are mixed together. Table 1 lists a variety of possible waste products types and colors.

TABLE 1

| 26 TEXTURES VARIETIES | COLORS - 14 BLENDS |
|---|---|
| Quartz - engineered | Pure white |
| Marble | Glacier white - cool shades |
| Soapstone | Cream white - Warm with black specs |
| Onyx | Beige - light, medium and dark |
| Limestone | Gray - light cool shades some white |
| Travertine | Gray - dark warm shades |
| Neolith | Brown - light warm shades |
| Glass - engineered | Brown - dark cool shades |
| Slate | Green - light cool shades |
| Dolomite | Green - dark black shades |
| Geoluxe | Black - midnight |
| Quartize | Orange - all varieties |
| Gneiss | Red - all varieties |
| Diabase | Earth - everything else |

TABLE 1-continued

| 26 TEXTURES VARIETIES | COLORS - 14 BLENDS |
|---|---|
| Basalt | |
| Gabbro | |
| Granodiorite | |
| Monzonite | |
| Syenite | |
| Anorthosite | |
| Schist | |
| Granulite | |
| Labradorite | |
| Pyrite | |
| Mica | |
| Garnets | |
| Other Granite Products | |
| Other Quartz Products | |

Sorting may also be accomplished semi-automatically or automatically, for example, using vision systems and color and texture recognition algorithms.

Figure 2:
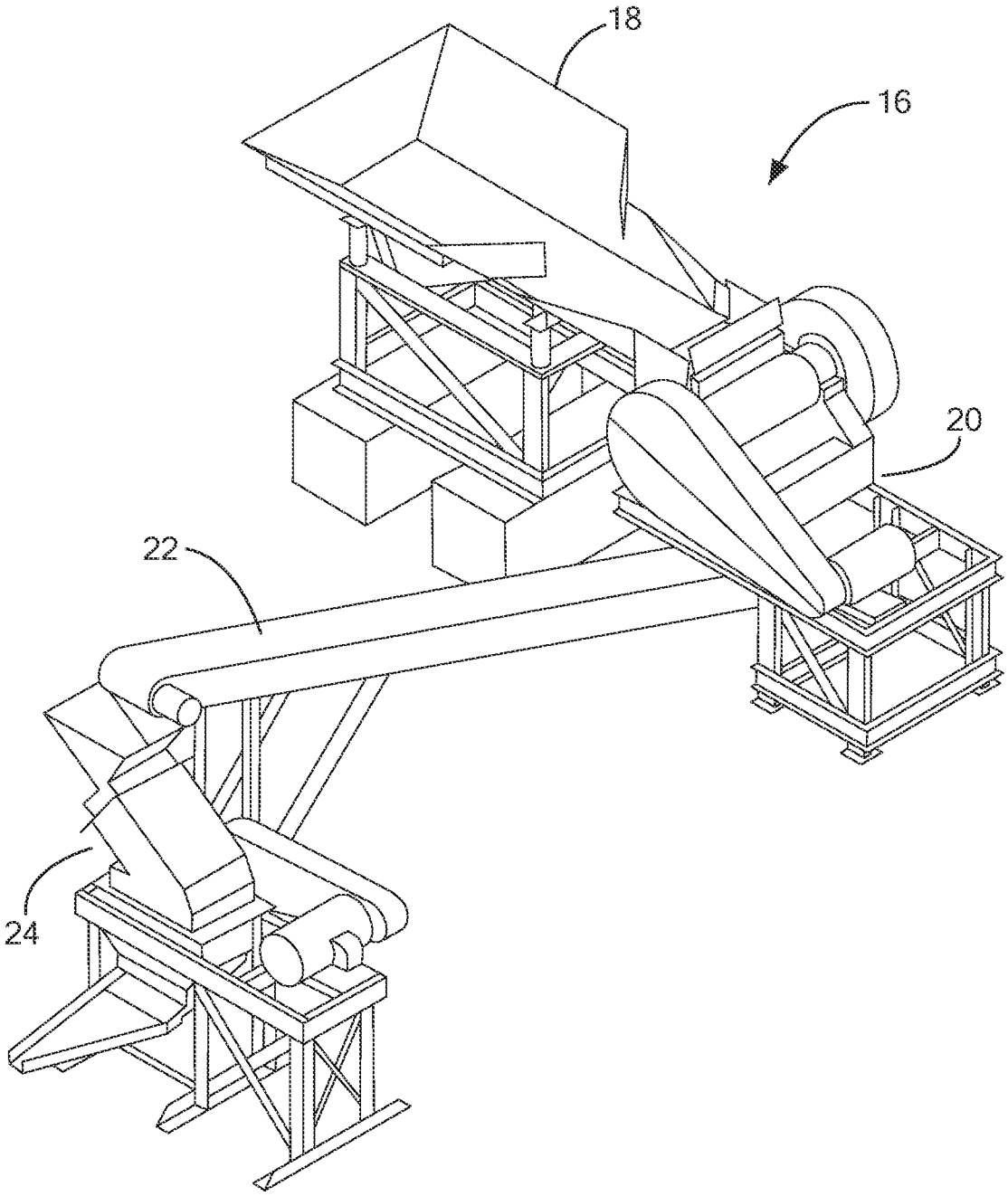
FIG. 2 is a schematic view of a two-stage stone crushing system used in a preferred example.

In step 14, the waste by-products are crushed using a two-stage crushing subsystem in one preferred embodiment. Crusher system 16, FIG. 2 includes first crushing station 16 and a second crushing station 24. A hammer mill or jaw crusher may be used depending on the Mohs scale of hardness of the product to be crushed. The product is loaded in hopper 18 and subjected to first crushing station 20 and the crushed stone is then conveyed via convenor 22 to a second crushing station 24, step 26, FIG. 1. The jaws of the first crushing station 20 may be set at ½ inch and the jaws of the second crushing station 24 may be set at ¼ inch. Double crushing ensures the stone is adequately crushed. For example, even though the jaws of crushing station 20 are set at ½ inch, not all the stones exit crushing station at ½ inch in size as some product is not adequately crushed in station 20. At station 20 and/or station 24, fines may be filtered out and can be packaged for sale as organic dust and/or soil mineralizer, step 28, FIG. 1.

Figure 3:
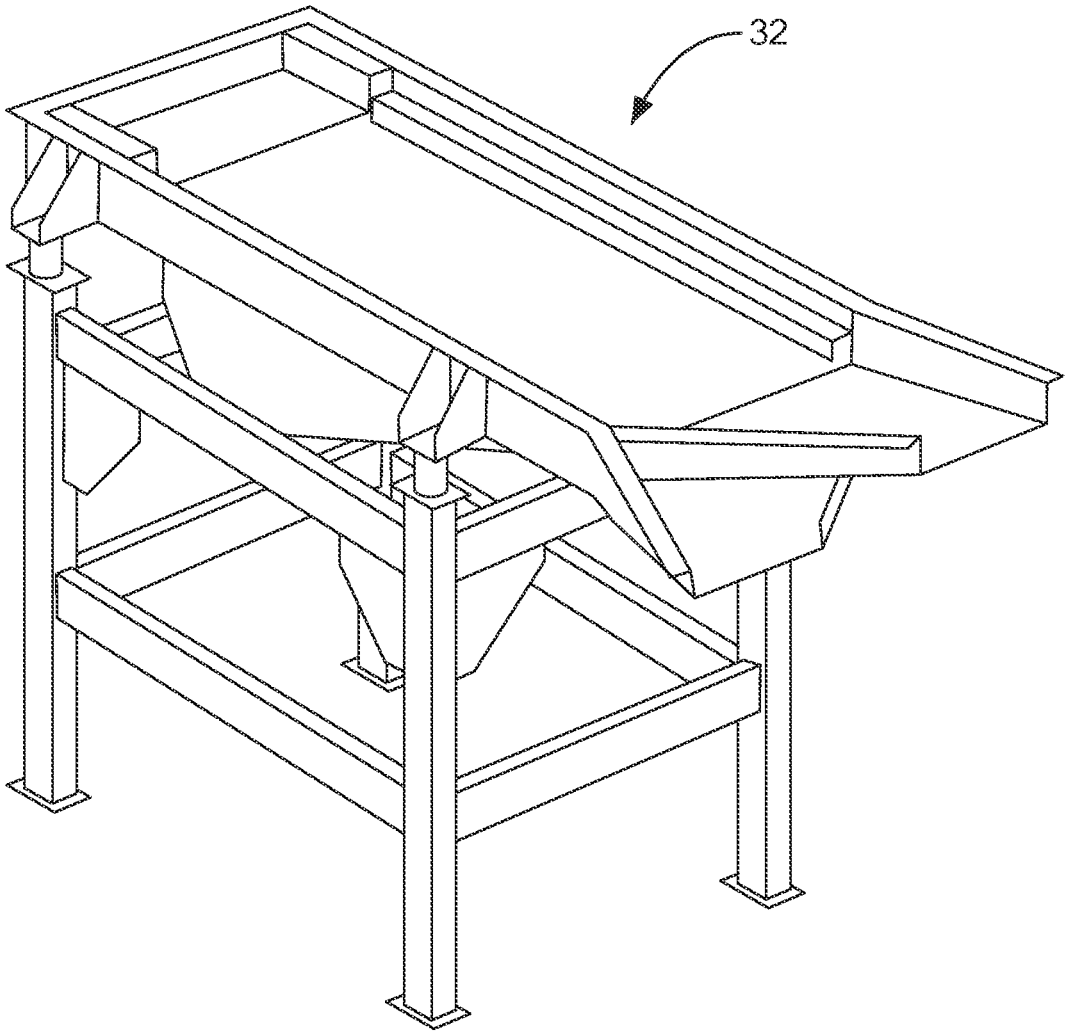
FIG. 3 is a schematic view of a preferred screening apparatus.
Figure 4:
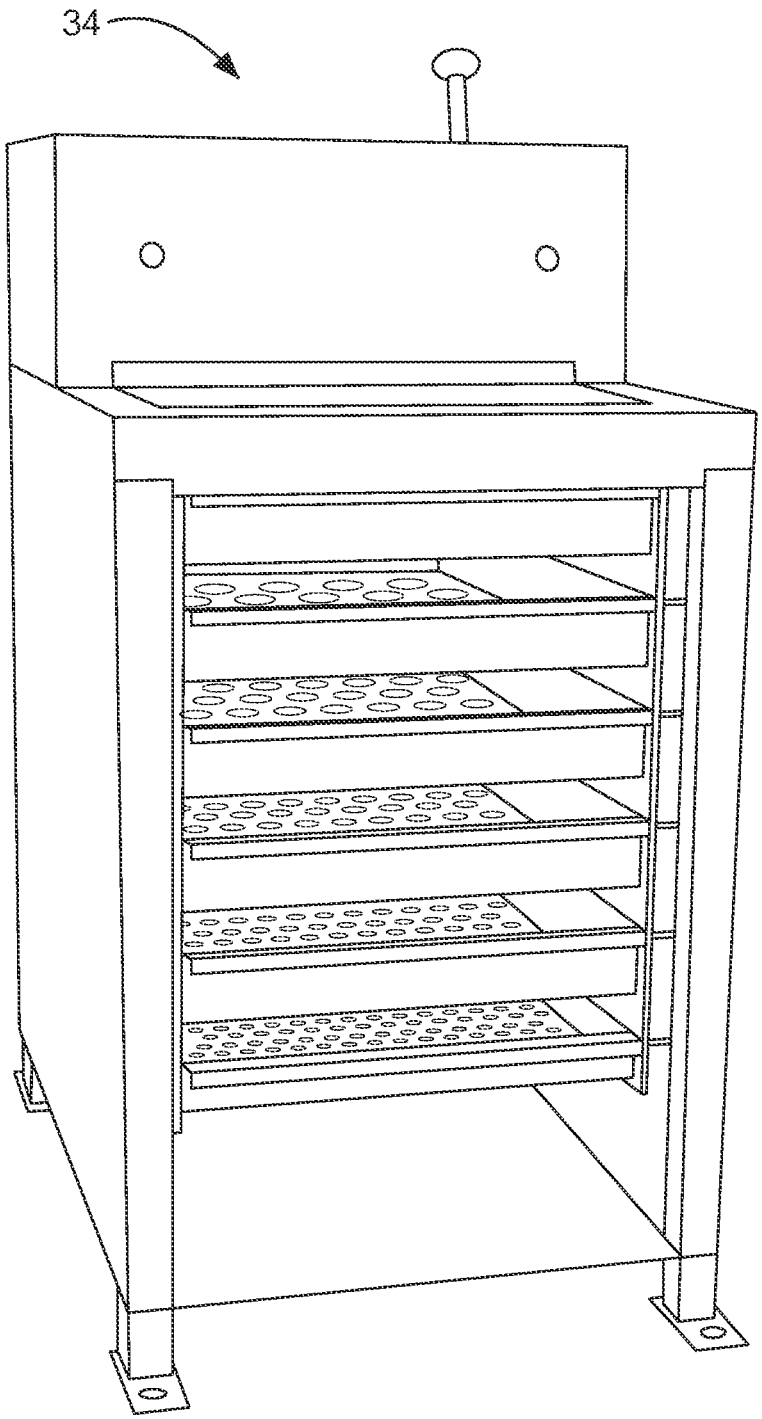
FIG. 4 is a schematic view of another screening apparatus.

At step 30, the crushed rock product is screened using screener 32, FIG. 3 (e.g., quartz screening) and/or screener 34, FIG. 4 (e.g., granite screening). The material may be screened in various sizes depending on the matrix of the stone. Tables 2 and 3 list preferred quartz and granite sieve sizes, respectively.

TABLE 2

QUARTZ SIEVE SIZES

Gradation

| Sieve Size | % Passing |
|---|---|
| 50 mm | 100.0 |
| 37.5 mm | 100.0 |
| 25 mm | 81.1 |
| 19 mm | 45.7 |
| 12.5 mm | 24.0 |
| 9.5 mm | 17.4 |
| 4.75 mm | 9.6 |
| 2.36 mm | 6.4 |
| 1.18 mm | 4.5 |
| 0.6 mm | 3.2 |
| 0.3 mm | 2.2 |
| 0.15 mm | 1.4 |
| 0.075 mm | 0.9 |

TABLE 3

GRANITE SIEVE SIZES

Gradation

| Sieve Size | % Passing |
|---|---|
| 50 mm | 100.0 |
| 37.5 mm | 100.0 |
| 25 mm | 95.9 |
| 19 mm | 73.7 |
| 12.5 mm | 49.6 |
| 9.5 mm | 41.2 |
| 4.75 mm | 28.7 |
| 2.36 mm | 20.2 |
| 1.18 mm | 13.2 |
| 0.6 mm | 8.5 |
| 0.3 mm | 5.1 |
| 0.15 mm | 3.0 |
| 0.075 mm | 1.7 |

Figure 5:
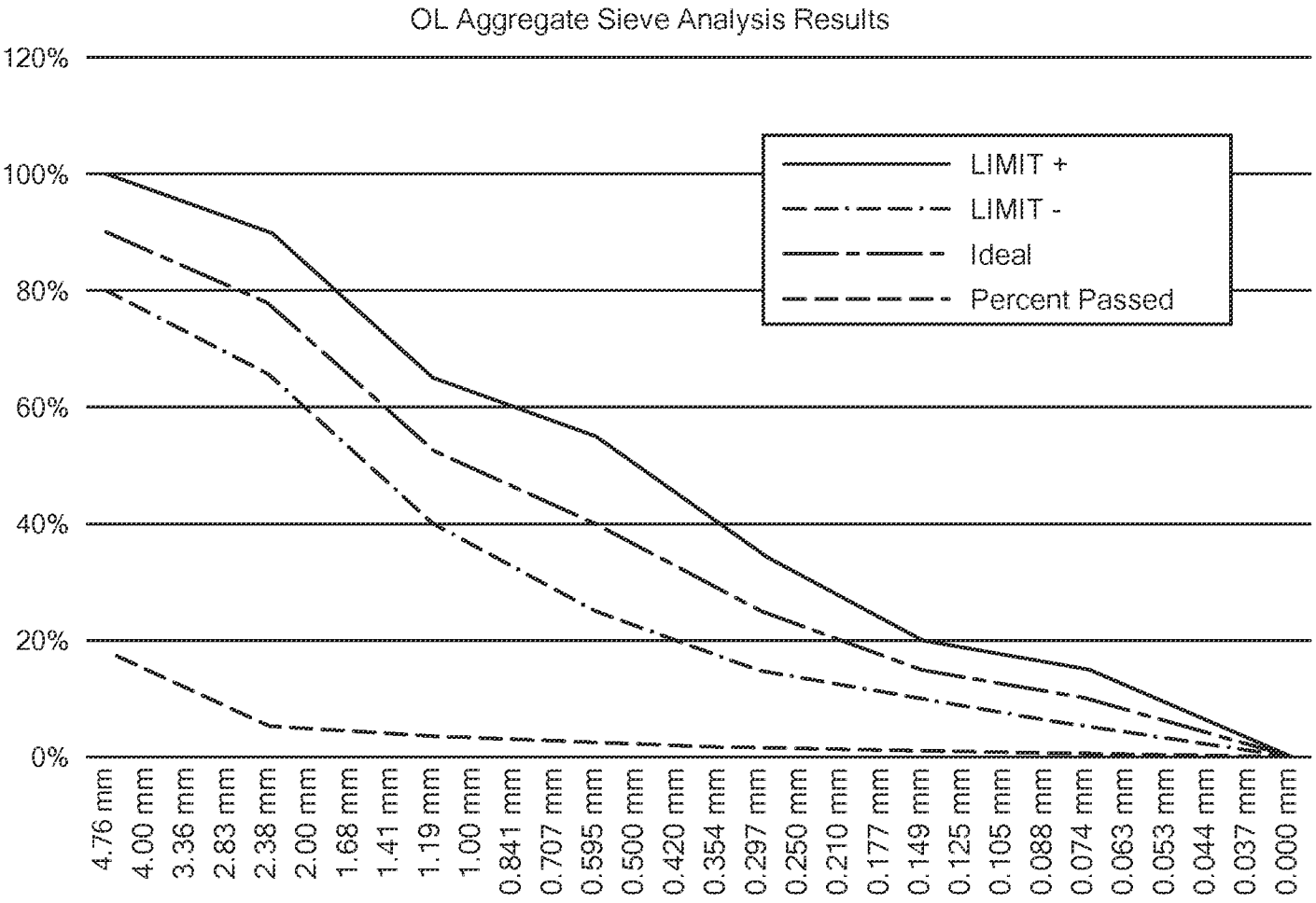
FIG. 5 is a chart depicting the aggregate sieve analysis results.

Table 4 and FIG. 5 depict a preferred aggregate sieve analysis.

AGGREGATE SIEVE ANALYSIS

| Standard | Mesh | LIMIT+ | LIMIT− | Ideal | Percent Passed | Weight Retained (g) |
|---|---|---|---|---|---|---|
| 25.4 mm | 1 in. | | | | 97.30% | |
| 22.6 mm | ⅞ in. | | | | | |
| 19.0 mm | ¾ in. | | | | 86.20% | |
| 16.0 mm | ⅝ in. | | | | | |
| 13.5 mm | 0.530 in. | | | | | |
| 12.7 mm | ½ in. | | | | 59.10% | |
| 11.2 mm | 7/16 in. | | | | | |
| 9.51 mm | ⅜ in. | | | | 48.50% | |
| 8.00 mm | 5/16 in. | | | | | |
| 6.73 mm | 0.265 in. | | | | | |
| 6.35 mm | ¼ in. | | | | | |
| 5.66 mm | No. 3½ | | | | | |
| 4.76 mm | No. 4 | 100% | 80% | 90% | 17.90% | |
| 4.00 mm | No. 5 | | | | | |
| 3.36 mm | No. 6 | | | | | |
| 2.83 mm | No. 7 | | | | | |
| 2.38 mm | No. 8 | 90% | 65% | 78% | 5.10% | |
| 2.00 mm | No. 10 | | | | | |
| 1.68 mm | No. 12 | | | | | |
| 1.41 mm | No. 14 | | | | | |
| 1.19 mm | No. 16 | 65% | 40% | 53% | 3.40% | |
| 1.00 mm | No. 18 | | | | | |
| 0.841 mm | No. 20 | | | | | |
| 0.707 mm | No. 25 | | | | | |
| 0.595 mm | No. 30 | 55% | 25% | 40% | 2.40% | |
| 0.500 mm | No. 35 | | | | | |
| 0.420 mm | No. 40 | | | | | |
| 0.354 mm | No. 45 | | | | | |
| 0.297 mm | No. 50 | 35% | 15% | 25% | 1.50% | |
| 0.250 mm | No. 60 | | | | | |
| 0.210 mm | No. 70 | | | | | |
| 0.177 mm | No. 80 | | | | | |
| 0.149 mm | No. 100 | 20% | 10% | 15% | 0.90% | |
| 0.125 mm | No. 120 | | | | | |
| 0.105 mm | No. 140 | | | | | |
| 0.088 mm | No. 170 | | | | | |
| 0.074 mm | No. 200 | 15% | 5% | 10% | 0.40% | |
| 0.063 mm | No. 230 | | | | | |
| 0.053 mm | No. 270 | | | | | |
| 0.044 mm | No. 325 | | | | | |
| 0.037 mm | No. 400 | | | | | |
| 0.000 mm | Pan | 0% | 0% | | 0.00% | |

Figure 6:
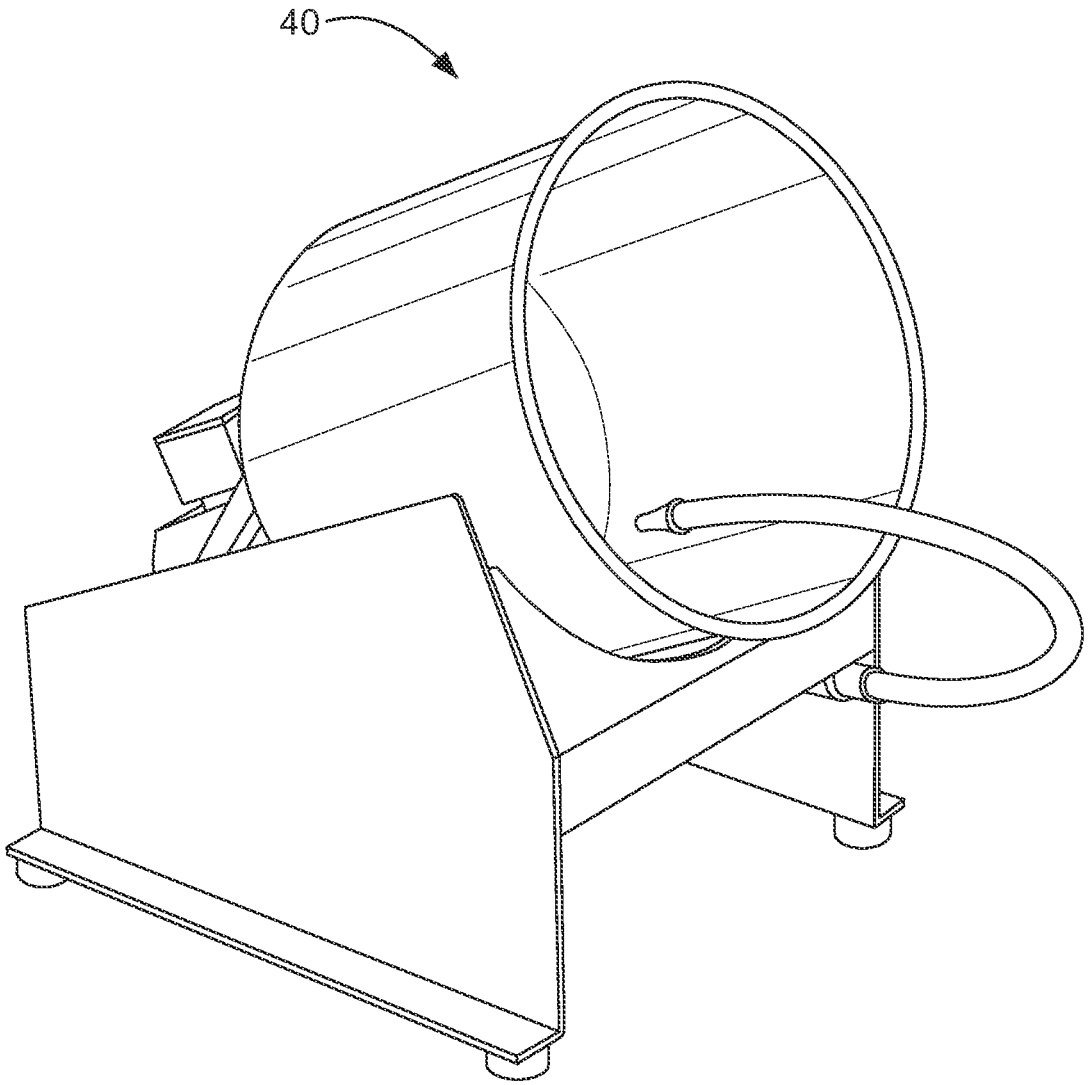
FIG. 6 is a schematic view showing an example of a washing system.
Figure 7:
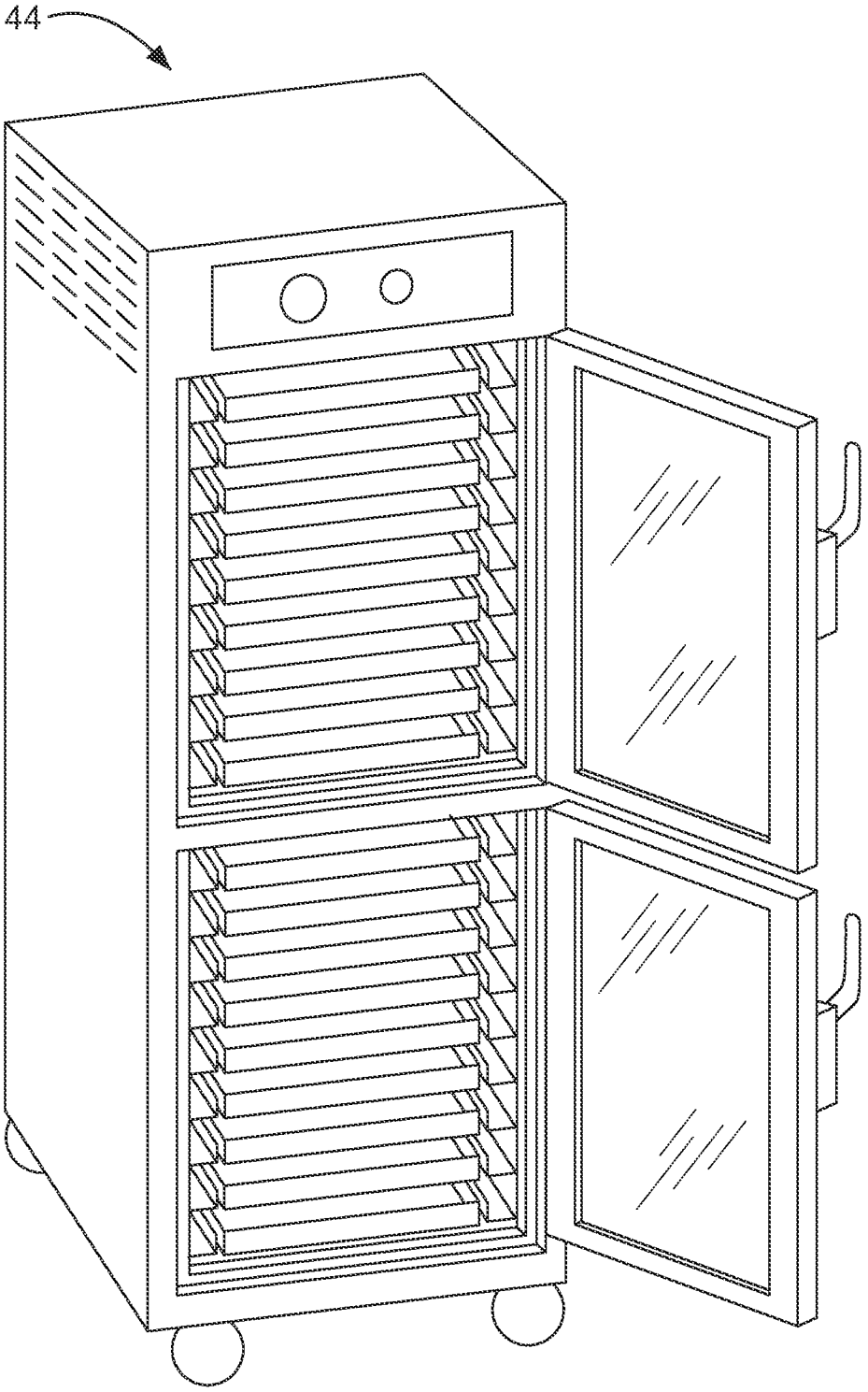
FIG. 7 is a schematic view showing an example of a drying cabinet with aluminum trays.

In step 36, FIG. 1, screened material at less than a predetermined size (e.g., #200) is placed directly into bags and sold as soil mineralizer and/or rock dust. The remaining stone may be washed, step 38 using, for example, washing subsystem 40, FIG. 6. Stone may be placed in washer 40 for 5 minutes to release any microsediment particles that may be left on the stone. Some stone may not need washing. In step 44, FIG. 1, the stone may be dried in a dryer 44, FIG. 2. Preferably, the stone is laid into individual aluminum trays in cabinet 44. FIG. 7 as aluminum conducts the necessary heat required to dry stone in a timely manner. The trays are placed in a holding cabinet for 10 minutes at 185° Fahrenheit in one example. Some stone may only require air drying. In step 46, FIG. 1, the resulting product is bagged or containerized depending on the usage application which may be for terrazzo, chip seal, eco-glitter, various coatings, for example, coatings applied to concrete and pool decks, as polysand, and other aggregate uses. In this way, for example, recycled aggregate of one color and size is available for an end use.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant cannot be expected to describe certain insubstantial substitutes for any claim element amended.

What is claimed is:

1. An aggregate production method comprising: procuring stone waste by-products; sorting the stone waste by-products by type and color and sorting various granites and quartz into different bins; subjecting the sorted stone waste by-products to a two-stage crushing process to produce aggregate; screening the aggregate into different sizes; and placing the aggregate according to size into a bag or container.

2. The method of claim 1 further including extracting product less than a predetermined size before washing and drying.

3. The method of claim 1 in which the waste by-products include stone remnants and/or construction debris.

4. The method of claim 1 further including drying the different size aggregate after washing the aggregate.

5. The method of claim 4 in which drying includes placing the aggregate into heated trays.

6. The method of claim 5 in which said trays are made of aluminum.

7. The method of claim 1 in which fines are extracted during crushing.

8. The method of claim 1 in which mineralizer and/or rock dust is extracted after screening.

9. The method of claim 1 further including washing the different size aggregate after screening.

10. An aggregate production method comprising: sorting stone waste by-products by type and color and sorting various granites and quartz into different bins; subjecting the sorted stone waste by-products to a crushing process to produce aggregate; screening the aggregate into different sizes; washing the aggregate; and placing the aggregate according to size into a bag or container.

11. The method of claim 10 further including extracting product less than a predetermined size before washing and drying.

12. The method of claim 10 in which the waste by-products include stone remnants and/or construction debris.

13. The method of claim 10, further including drying the aggregate by placing the aggregate into heated trays.

14. The method of claim 13 in which said trays are made of aluminum.

15. The method of claim 10 in which the crushing process is multistage.

16. The method of claim 15 in which a first stage produces larger aggregate and a second stage produces smaller aggregate.

17. The method of claim 10 in which fines are extracted during crushing.

18. The method of claim 10 in which mineralizer and/or rock dust is extracted after screening.

19. An aggregate production method comprising: procuring stone waste by-products; sorting the stone waste by-products by type and color and sorting various granites and quartz into different bins; subjecting the sorted stone waste by-products to a crushing process to produce aggregate and fines; extracting the fines; screening the aggregate into different sizes; extracting mineralizer and/or rock dust; and placing the aggregate according to size into a bag or container.

20. The method of claim 19 in which the waste by-products include stone remnants and/or construction debris.

21. The method of claim 19 further including washing the different size aggregate after crushing and then drying the aggregate.

22. The method of claim 21 in which drying includes placing the aggregate into heated trays.

23. The method of claim 19 in which fines are extracted during crushing.

24. The method of claim 19 in which mineralizer and/or rock dust is extracted after screening.

25. The method of claim 19 in which the crushing process is multistage.

26. The method of claim 25 in which a first stage produces larger aggregate and a second stage produces smaller aggregate.

* * * * *